United States Patent [19]

Shimada

[11] 4,270,376

[45] Jun. 2, 1981

[54] TWIST ROLLER GUIDE DEVICE FOR ROLLING MILL USE

[75] Inventor: Hiroaki Shimada, Sapporo, Japan

[73] Assignee: Kotobuki Sangyo Kabushiki Kaisha, Sapporo, Japan

[21] Appl. No.: 19,777

[22] Filed: Mar. 12, 1979

[51] Int. Cl.[3] ..... B21B 39/28

[52] U.S. Cl. ..... 72/231; 72/250

[58] Field of Search ..... 72/231, 250

[56] References Cited

U.S. PATENT DOCUMENTS

| | | | |
|---|---|---|---|
| 1,157,378 | 10/1915 | Geer | 72/231 |
| 1,405,985 | 2/1922 | Ekstrand | 72/231 |
| 3,013,453 | 12/1961 | Rodnick | 72/428 X |
| 3,776,013 | 12/1973 | Groh | 72/250 X |

*Primary Examiner*—Milton S. Mehr

*Attorney, Agent, or Firm*—Oldham, Oldham, Hudak & Weber

[57] ABSTRACT

A twist roller guide having a minimized overall length, including a guide box, a twist guide member having a twisted through hole for giving preliminary twist to the stock passing therethrough, and a roller holder consisting of a hollow cylindrical body portion and a pair of bearing plates extending forwardly therefrom to support a pair of twist rollers therebetween. The twist guide member consists of an enlarged head portion defining an inlet opening therein and a tubular body portion, the head portion being fitted in a bracket portion of the guide box formed adjacent to the rear end thereof. The body portion of the twist guide is fitted in the hollow cylindrical body portion of the roller holder, which is firmly supported in another bracket portion of the guide box formed adjacent to the front end thereof. The twist guide is beveled at the top and bottom of its exit end face so that it may be placed quite close to the twist rollers.

3 Claims, 7 Drawing Figures

TWIST ROLLER GUIDE DEVICE FOR ROLLING MILL USE

BACKGROUND OF THE INVENTION

The present invention relates generally to rolling apparatus including a plurality of rolling mills arranged in series for progressive rolling of wire rods, steel sections, steel bars or the like stock materials. In such rolling mill arrangement, twist roller guide devices are employed in a continuous rolling operation in which the stock being rolled is properly twisted between each two adjacent rolling mills from its state as extended out of the preceding mill so as to run into the following mill in a state raised in transverse cross section vertically or, as with the case of a stock of rectangular cross section, at an angle of inclination of 45 degrees and the guide devices are each arranged adjacent to the exit of the preceding rolling mill to receive the stock as extended therefrom and impart to the stock an angle of twist required. The present invention relates particularly to twist roller guide devices of the kind described.

Generally, in the continuous rolling operation of a set of horizontal rolling mills, it is requisite that the stock bar extended from between the working rolls of the preceding rolling mill (which will be referred to hereinafter as the first rolling mill) and having a longitudinal axis of cross section that is horizontal is twisted in order that it may be introduced into the roll nip of the second or following rolling mill with the cross-sectional axis raised to the vertical or at an angle of 45 degrees.

An advanced form of twist a roller guide device for rolling mill use includes a pair of adjustable top and bottom twist rollers which receives the stock as extended from the first rolling mill and having the longitudinal axis of cross section horizontally directed and gives to the stock a definite angle of twist to place the cross-sectional axis at a predetermined angle of inclination to the horizontal.

In operation, the steel bar or other stock received in the twist roller guide continues to advance while turning gradually in accordance with the exact angle of twist given by the paired twist rollers of the guide device and reaches the roll groove of the second rolling mill, assuming a state raised as described above at the roll nip point. With such guide devices arranged between the successive rolling mills, the stock is rolled progressively, entering each of the rolling mills stably in a definite cross-sectional attitude. This makes it possible at all times to obtain a desired high quality product having an exact reduced cross-sectional shape and area.

Such technique of twisting a stock being rolled into a raised state of cross section by use of a pair of twist rollers is generally considered highly reliable but involves some problems as described below.

In the twist roller guide device, the paired twist rollers are set an angle corresponding to the predetermined angle of twist to be given to the stock and, because of this, if the stock as extended out of the first rolling mill in a state having a horizontally directed longitudinal axis of cross section be introduced in that state into the paired twist rollers, the forward end of the stock must come into collision with the twist rollers and hence both the stock end portion and the twist rollers be heavily damaged.

To overcome this situation, it has been common practice to employ twist guide means having a guide aperture or bore defined therein to receive the stock as extended out of the first rolling mill. The guide bore has its wall surface twisted so that the stock received therein is gradually preliminarily twisted before entering into engagement with the twist rollers. As will be readily noted, a distance of stock travel exceeding a definite length is necessary for the stock to be twisted to such an extent that there is no excessive impact occuring between the twist rollers and the stock reaching the latter. On the other hand, the paired twist rollers are supported by a rigid framework so as to be able to grippingly hold the strip passing at high speed therebetween thereby to impart to the stock a predetermined amount of twist, overcoming the rigidity of the stock material. The framework is of a substantial size, including a centering grip mechanism needed for fine adjustment of the distance between the twist rollers to impart an optimum angle of twist to the stock, and is arranged to support the twist rollers at its end adjacent to the second or next following rolling mill. The framework itself is fixed on top of a firm rest bar or support bed. Since the twist guide described above and the framework supporting the paired twist rollers are arranged in series with each other, the distance between the stock exit of the first rolling mill and the paired twist rollers, that is, the axial length of the twist roller guide device used between the rolling mills tend to be relatively large.

Accordingly, in the past any rolling apparatus including a plurality of rolling mills arranged in series must as a whole have a substantially long axial length as long as if includes guide devices of the type described interposed between the rolling mills. Contrariwise, where such rolling apparatus is installed in limited space, sometimes it has been impossible to obtain between each two adjacent mills an axial distance enough to accommodate a guide device of the type described and friction guide means must be restored to at the sacrifice of the rolling accuracy of the apparatus.

SUMMARY OF THE INVENTION

The present invention relates to twist roller guide devices of the type described and is intended to overcome the difficulties previously encountered as described above.

The present invention has for its primary object the provision of a twist roller guide device for rolling mill use the entire length of which is reduced to a minimum.

Another object of the present invention is to provide a twist roller guide device of the character described which is capable of twisting the stock being passed therethrough so as to impart thereto a predetermined angle of twist without strain.

A further object of the present invention is to provide a twist roller guide device which has a minimized overall length and is capable of giving an extremely accurate angle of twist to the stock thereby to enable the associated rolling apparatus to operate with increased smoothness and rolling accuracy so that products improved in quality are obtained.

To attain these objects, the twist roller guide device of the present invention is constructed and arranged as described below.

In the guide device, the twist guide member, which is arranged close to the exit of the first rolling mill and has a guide bore defined therein to receive the stock as extended out of the rolling mill, is formed in the following configuration, for example, for stocks of elliptic cross section. Specifically, the lower half of the wall surface of the guide bore consists of two laterally neighboring regions both formed arcuate in transverse cross section, one side region serving as a twisting surface slidingly engaging one half portion of the bottom surface of the stock having an elongate elliptic or convex lens-like cross section. The other side region of the lower wall surface of the guide bore is recessed more deeply than the stock-engaging region to be clear of the stock. The top half of the wall surface of the guide bore is formed in symmetry with the bottom half thereof with respect to the center line of the guide bore. The top and bottom stock-engaging surfaces of the guide bore, which are diametrally opposite to each other, are arcuate surfaces generally inclined, at the stock-receiving end thereof, at the same angle as the corresponding regions of the top and bottom surfaces of the stock of elliptic cross section now having a horizontal major axis but extend helically about the bore axis, being twisted increasingly toward the exit end of the guide bore, to serve as working surfaces effective to twist the stock as it proceeds thereon. Obviously, the clearance surfaces are also helical along the bore axis in the same fashion as the stock-engaging surfaces. In this manner, the guide bore forms along the major part of its length a twisted hole having smooth wall surfaces gradually twisted along the bore axis. The stock once received in such twisted hole obviously proceeds along the twisted wall surfaces thereof while being twisted thereby. That is to say, the stock is given a definite amount of preliminary twist during its passage through the guide bore. The amount of twist imparted to the stock by the twist guide is selected at a value slightly smaller than the angle of twist ordinarily imparted by a pair of twist rollers.

The guide bore has a cross-sectional size varying along its longitudinal axis. Specifically, it has an inlet end portion widely enlarged adjacent to a guide piece provided to guidingly receive the stock as extended from between the working rolls of the first rolling mill and, inside of the enlarged end portion, is reduced in cross-section size to such an extent as to approximately correspond to the cross section of the stock to merge into the twisted hole region, which remains practically unchanged in cross sectional area along its length reaching the exit end of the guide bore. As described hereinbefore, in this last region are formed the twisting and clearance surfaces of the twist guide. In most cases, the twist guide is of the structure divided into two, top and bottom members, which are assembled into an integral tubular body with the aid of an appropriate frame structure.

On the other hand, the paired top and bottom twist rollers are rotatably supported on a guide box at its forward end portion by means of a pair of spaced bearing bracket plates provided on the opposite sides of a roller holder, which is supported by the guide box, which in turn is mounted on a rest bar. The paired twist rollers are each of the previously known type consisting of a cylindrical-shaped section and a frustoconical-shaped section and are arranged one over the other symmetrically in axially opposite directions.

According to a characteristic feature of the present invention, the roller holder is made in the form of a hollow cylindrical member to fittingly receive the exit side portion of the tubular body of the twist guide whereby the exit end of the latter is held in closely spaced opposite relation to the paired top and bottom twist rollers.

The guide box is extended at its end adjacent to the first rolling mill toward the latter and is formed on the extended end portion with a support base adapted to receive the adjacent, inlet end portion of the twist guide whereby not only the twist guide is supported with increased stability but the whole device can readily be made compact.

Further, in the device, the paired twist rollers are mounted on a pair of top and bottom eccentric shafts extending between the bearing bracket plates and each supported at one end on the respective bearing bracket plate by means of a bearing sleeve or bushing rotatably fitted therein. In order to enable the two bearing sleeves to be adjusted in angular position symmetrically with each other, a self-centering grip control mechanism is provided. The hollow cylindrical portion of the roller holder, having a cylindrical outer peripheral surface, is rotatably supported in a cylindrical bore formed in the guide box and a worm gear plate is provided on a flange formed on the hollow cylindrical holder portion for meshing engagement with a worm rotatably mounted on the guide box. With such additional arrangement, not only the distance between the axis of the paired twist rollers can be changed but also the angle of inclination of the bearing bracket plates is adjustable and the angle of twist to be given to the stock by the twist rollers can be finely adjusted with increased ease.

The above and other objects, feature and advantages of the present invention will become apparent from the following description when taken in conjunction with the accompanying drawings, which illustrate a preferred embodiment of the invention.

DESCRIPTION OF THE PREFERRED EMBODIMENTS

Figure 1:
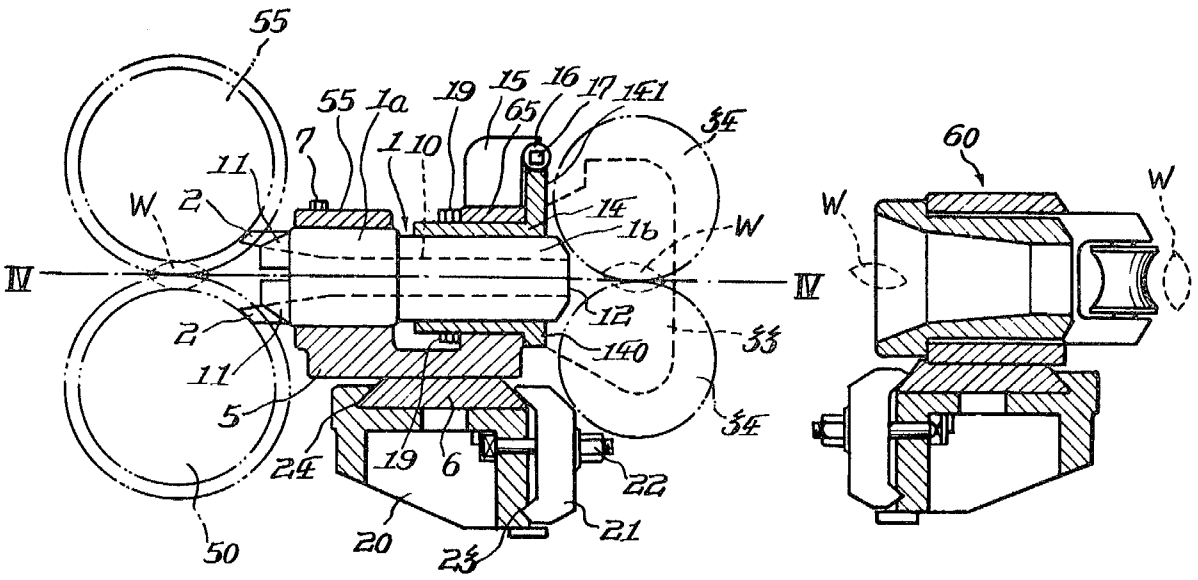
FIG. 1 is a side elevational view of a twist roller guide device embodying the principles of the present invention, as employed in combination with an entrance roller guide of a rolling mill.

In FIG. 1, reference numeral 50 indicates a pair of working rolls of the first rolling mill and the stock steel W as delivered therefrom, shown in this embodiment as having a flattened, elongate elliptic cross section, is received first in a twist guide 1 and, passing through a pair of top and bottom twist rollers 34, shown in chain-dotted lines, is directed to an inlet roller guide 60 provided to guide the stock into the second rolling mill not shown. The stock W rolled by the working rolls 50 is received in the twist guide 1 in the state as delivered with the major axis of the elliptic cross section held horizontal and is given a predetermined angle of twist by the paired twist rollers 34, as indicated by the broken lines, before entering the inlet roller guide 60. In the latter, the stock is progressively twisted, as it proceeds, in accordance with the angle of twist of the inlet roller guide 60 so that when leaving the guide 60 the stock has its major cross-sectional axis directed substantially vertical, as indicated in the right-hand end of FIG. 1. That is to say, the stock is twisted so as to assumes a vertical attitude at its forward end at the instant when it reaches the roll groove of the second rolling mill.

Figure 2:
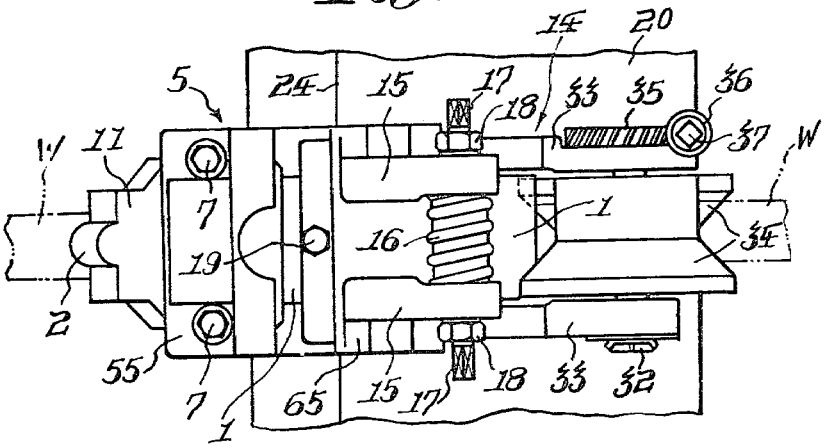
FIG. 2 is a plan view of the twist roller guide device.
Figure 4:
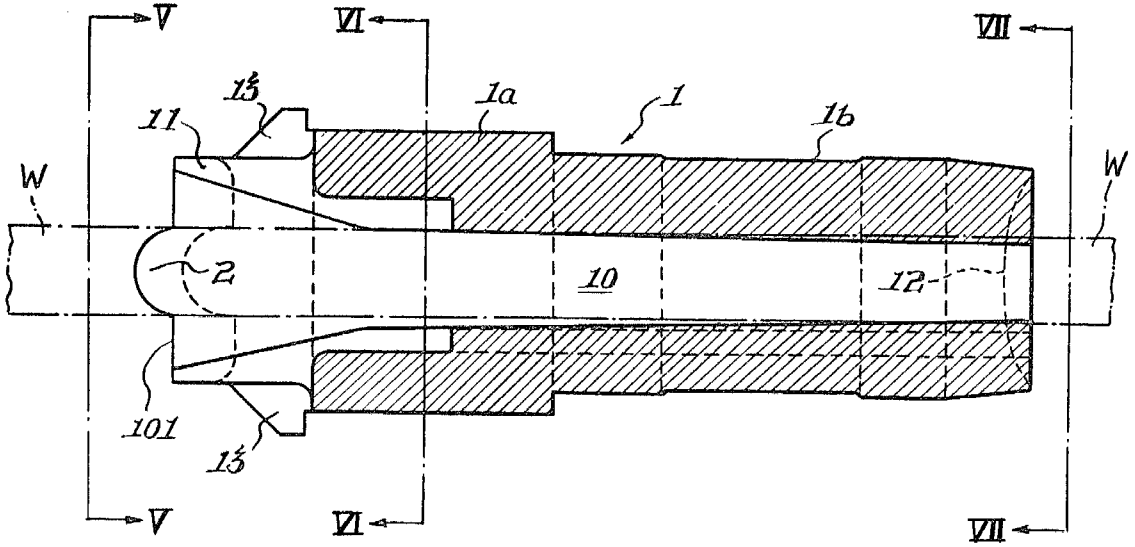
FIG. 4 is a longitudinal cross-sectional view of the twist guide of the guide device shown in FIGS. 1 to 3, taken along the line IV—IV in FIGS. 1, 5, 6 and 7.

Referring to FIGS. 1, 2 and 4, the twist guide 1 has a guide bore 10 formed therein which extends axially through its body in the direction of the pass line.

Provided on the twist guide 1 at its inlet end are a pair of upper and lower guide pieces 11, which together define a guide opening effective to catch the incoming stock W, and a pair of upper and lower guide projections 2, which serve to prevent the stock from being withdrawn out of the guide bore as when it remains more or less closely stuck in the roll groove of working rolls 50. As illustrated, the guide projections are each extended into the roll groove in the adjacent one of the working rolls 50 and formed with a guide surface extending along the wall surface of the roll groove in a direction tangential thereto and with a minimum spacing therefrom.

Figure 5:
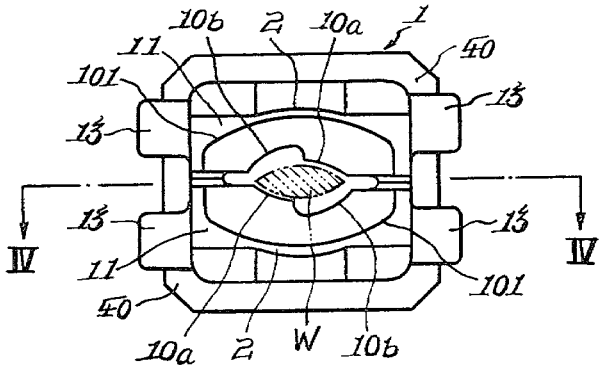
FIG. 5 is a rear view of the twist guide, taken in the plane of the chain-dotted line V—V of FIG. 4 looking in the direction indicated by the arrows.
Figure 6:
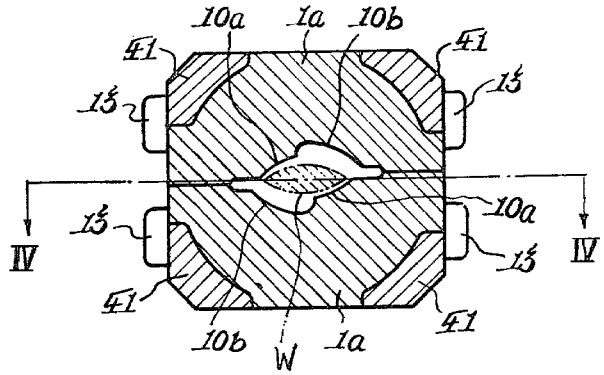
FIG. 6 is a cross-sectional view of the same, taken along the chain-dotted line VI—VI in FIG. 4.
Figure 7:
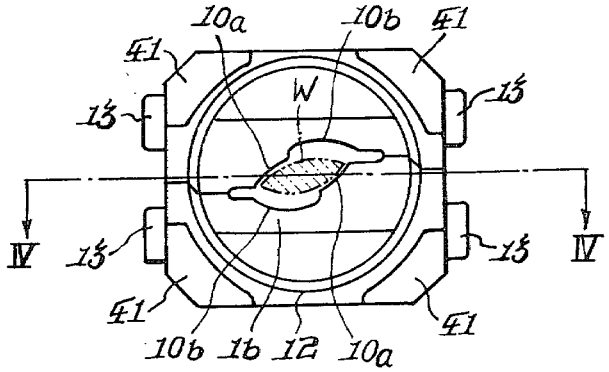
FIG. 7 is a front elevational view of the twist guide, taken on the plane of the chain-dotted line VII—VII of FIG. 4, looking in the direction indicated by the arrows.

As observed from FIGS. 4 and 5, the guide bore has an inlet opening 101 of substantial size which is horizontally elongate and extends into the somewhat enlarged head portion 1*a* of the twist guide, while rapidly and smoothly converging to merge into a twisted portion of the guide bore, which will be described below. The twisted bore portion, constituting the most part of the guide bore 10, is a through hole having a transverse cross section elongated generally in a horizontal direction, as shown in FIGS. 5, 6 and 7. Specifically, about one half (in FIG. 5, the right-hand half) of the lower half portion of the twisted through hole is defined by an arcuate wall surface 10*a*, corresponding to the right-hand lower half portion of the cross section of the stock W, while the other half of the lower half hole portion is defined by an arcuate clearance surface 10*b*, which is set more deeply than the surface 10*a*. The upper half portion of the twisted hole is formed in symmetrical relation to the lower half portion with respect to the longitudinal axis of the twisted hole, the left-hand and right-hand halves of the upper half hole portion being respectively defined by an arcuate surface 10*a* and a clearance surface 10*b*.

As shown in FIG. 5, the upper and lower arcuate wall surfaces 10*a* of the twisted hole, which are diametrically opposite to each other, are generally inclined at the inlet end thereof at the same angle as that of the corresponding surface regions of the stock W as entering the twisted hole with its major cross-sectional axis horizontally directed and are increasingly twisted along the hole axis toward the exit end 12 of the twisted hole, as seen in FIGS. 4 and 7, their angle of inclination varying increasingly to attain a definite value at the hole exit end 12, to serve the purpose of gradually twisting the stock coming into sliding engagement with such hole wall surfaces. It goes without saying that the clearance surfaces 10*b* are also increasingly twisted in accordance with the twist of the working surfaces 10*a* to complete the twisted hole. In this manner, the twisted hole is as a whole gradually and smoothly twisted, forming a major portion of the guide bore 10 extending adjacent to the exit end thereof. As illustrated, there is provided a laterally extending groove on each side of the twisted hole between the adjacent working and clearance surfaces 10*a* and 10*b*. The side grooves are formed, in cases where the twist guide is made as by casting in a form divided into two separate top and bottom halves, as in this example, substantially in the plane in which the two halves about on each other. These grooves are intended to serve the purpose of preventing the formation of a sharp-edged shoulder on each hole side at the junction of the adjacent twisting and clearance surfaces 10*a* and 10*b* which may impair the stock or the wall surfaces of the twisted hole.

The two half sections of the twist guide 1 are assembled together in properly adjusted relative positions to define a guide bore 10 exactly in specified configuration. For example, as seen in FIGS. 5, 6 and 7, a rectangular clamp frame is fitted over the front end of the head portion of the twist guide 1 to fix to four support beams 41 in place, which are held fixedly against the body of the twist guide at four corners thereof, so that the guide body is assembled into an integral tubular unit.

The tubular body of twist guide 1 is, as seen in FIGS. 1 and 7, beveled at the exit end 12 at least at the top and bottom of the end face so that the exit of the guide bore 10 (that is, of the twisted hole) may be placed fully close to a pair of top and bottom twist rollers 34, which will be described below. The major portion 1*b* of the body of twist guide 1, which lies adjacent to the exit end thereof, is made smaller in outside diameter than the head portion 1*a* of the twist guide for convenience of fitting connection with the twist roller assembly.

Figure 3:
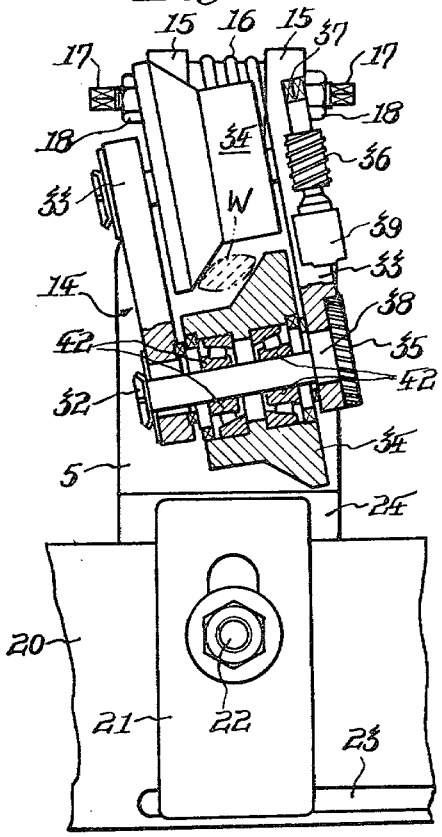
FIG. 3 is a fragmentary front view, partly in cross section, of the same.

Specifically, referring to FIGS. 1, 2 and 3, the paired twist rollers 34 are supported by a roller holder 14 which in turn is supported on a guide box of sturdy structure, 5. On the underside of the guide box 5 is firmly secured a bed plate of trapezoidial cross section, 6, which is firmly secured to the top of a rest bar 20 with one of the opposite side edge portions of the bed plate 6 tightly fitted in a recessed groove 24 formed at the top of rest bar 20 on one side thereof, the other side edge portion of bed plate 6 being clamped against the rest bar 20 by means of a U-shaped clamp piece 21. Reference numeral 22 indicates a clamp-tightening nut and 23 a side groove formed in the adjacent side of rest bar 20 to receive one of the two legs of clamp piece 21.

Referring again to FIGS. 1, 2 and 3, the roller holder 14 is provided on the opposite sides of its forward stock exit end portion with a pair of flat bearing plates 33 that extend in parallel longitudinally of the roller holder 14 to define a vertical space therebetween in which the paired top and bottom twist rollers 34 are rotatably supported. The twist rollers 34 are each of the known form consisting of two axial half sections, one cylindrical in shape and the other flaring or diverging therefrom in frustoconical shape. As seen in FIGS. 2 and 3, the twist rollers 34 are arranged one over the other in axially opposite directions, that is, in axial orientation opposite to each other so that the frustoconical sections of the respective twist rollers 34 effectively cooperate to twist the stock W.

In the embodiment illustrated, the paired twist rollers 34 are rotatably mounted on a pair of eccentric shafts 32, which are fixed at one end to respective bearing sleeves or bushings 38 (only one of which is shown in FIG. 3) in radially oppositely offset relation thereto. The two bearing sleeves 38 are rotatably fitted in the respective bearing plates 33 at different vertical locations thereon. A pair of right-handed and left-handed worm wheels 35 (FIGS. 2 and 3) are fixedly secured to the outer ends of the upper and lower bearing sleeves 38, respectively, and are held in mesh respectively with right-handed and left-handed worms 36 fixed by mounted on a common mandrel 37, which is journaled in a bracket 39 provided therefor. With this arrangement, it will be readily noted that the shafts of two twist rollers 34 can be vertically displaced symmetrically with each other, by turning the mandrel 37 about its axis, for example, by applying a tool such as a wrench to the square head of the mandrel 37 formed at one end thereof.

The present invention is characterized in that the roller holder 14, serving to support the paired twist rollers 34, has a body portion formed in hollow cylindrical shape to fittingly receive the axially forward portion of the tubular body of twist guide 1.

As illustrated in FIG. 1, the hollow cylindrical portion of the roller holder 14 has a cylindrical outer peripheral surface and is rotatable supported by a bored support bracket 65 formed integrally on the guide box 5 adjacent to the forward end thereof. The roller holder body is formed at the forward end thereof with a radial flange 140, which is held on the front end face of the support bracket 65, and carries stop screws 19 set to engage the rear end face of the bracket 65 so that the roller holder 14 is securely held in place against axial dislocation relative to the support bracket.

The flange portion 140 of roller holder 14 is extended upwardly at its top to form a worm wheel segment 141 thereon, which is placed in mesh with a worm 16 fixedly mounted on a shaft journaled at its opposite ends in respective bearing brackets 15, which are provided on top of the support bracket 65. As will readily be noted, when the worm shaft is turned, the roller holder 14 rotates about the axis of the cylindrical outer peripheral surface of its hollow cylindrical body portion. Reference numeral 17 indicates the square-headed opposite ends of the worm shaft and 18, positioning nuts thereon.

The guide box 5 is rearwardly extended to form a U-shaped bracket portion designed to support the enlarged head portion 1*a* of the twist guide described above. Reference numeral 55 indicates retainer plate means secured to the top of the U-shaped bracket portion by bolts 7.

In the device described, the twist guide 1, supported together with the roller holder 14 on the guide box 5 secured to the top of rest bar 20, is apparently held with the axis of its guide bore 10 coinciding with the pass line of the rolling mills, with which also the axis of the hollow cylindrical portion of the roller holder 14 coincides. Further, it is to be noted that the top and bottom bearing sleeves 38 fitted to respective bearing plates 33 are held in positions symmetrical with each other with respect to the pass line.

Accordingly, as long as the twist guide 1 is axially positioned with its beveled exit end 12 held as closely as possible to the paired twist rollers 34, the exit end opening of guide bore 10 is centered on the pass line extending through the twist roller set and at a point fully close thereto. On the other hand, the inlet end region of twist guide 1 is arranged, as described previously, with its guide projections 20 held extremely close to the working rolls 50 of the first rolling mill. It will be apparent that the rest arm 20 serves to support the whole assembly of the twist roller guide device of the present invention.

In operation, the stock W as extended from between the working rolls 50 is immediately received in the twist guide 1, is preliminarily twisted as it proceeds therethrough slidingly engaging the twisted surfaces 10*a*, and then is fed out of the exit end 12 of twist guide 1 into the pair of twist rollers 34, which are positioned extremely close to the guide end 12. As stated before, the angle of twist given to the stock W by the twist guide is smaller than that ordinarily given thereto by twist rollers 34.

The paired twist roller 34 give the stock W a predetermined angle of twist that can be finely adjusted, for example, by turning the bearing sleeves 38 and/or the roller holder 14.

As the angle of twist given to the stock W by the twist rollers is larger than that preliminarily given thereto by the twist guide 1, the stock once reaching the twist rollers 34 remains no longer in the state tightly engaging the twisted, working surfaces of the twist guide. The stock, leaving the twist rollers, proceeds while turning in accordance with the angle of twist finally given thereto and reaches the entrance of the second rolling mill with the major axis of its cross section held vertical as long as the given angle of twist is correct.

In conventional twist roller guide devices, a twist guide has been provided which takes the form of a separate part having a required length and supported adjacent to the exit of the first rolling mill and, next to such twist guide, a roller support has been arranged which supports a pair of twist rollers on its forward end portion. With this arrangement, it is required that the roller support and the first rolling mill be spaced from each other substantially by a distance enough to accommodate the whole length of the twist guide therebetween. In addition, the distance between the twist guide and the twist rollers must be of a length enabling arrangement of the support frame.

In contrast to this, in the device of the present invention, there is no need for any extra space between the exit of the first rolling mill and the paired twist rollers 34 beyond the net length required for the twisted surfaces of twist guide 1 to impart a desired preliminary twist to the stock. Accordingly, the whole of the device can be assembled in a length much reduced compared with conventional devices.

Further, in the device of the present invention, since the twist guide 1 has a length enough to impart to the stock a desired preliminary twist and the stock leaving the exit end of its twisted hole is immediately fed to the paired twist rollers, there is no danger that the stock be undesirably deformed on its way or its introduction to the paired twist rollers fail.

It will be apparent that the twist roller guide device of the present invention enables, because of its reduced length, a substantial reduction in distance between the first and second rolling mills and thus makes it possible to minimize the total length of the pass line in any number of rolling mills arranged in series.

A further advantage of the present invention is that if enables use of a highly accurate stock guide, of the twist roller type, between two rolling mills arranged rather closely to each other.

Though one preferred embodiment of the present invention has been shown and described, it will be apparent to those skilled in the art that various changes and modifications may be made therein without departing from the spirit of the invention or the scope of the appended claims.

What is claimed is:

1. A twist roller guide device to be arranged between each two adjacent rolling mills in a set of aligned rolling mills and of the type including a pair of upper and lower twist rollers 34 and a twist guide member 1 having a guide bore 10 formed therein with two diametrally opposite helically extending wall surfaces 10*a* effective to preliminarily twist the stock as the latter proceeds through the guide bore, said device being characterized in that said pair of twist rollers are journaled on respective bearing plates 33 provided on a hollow cylindrical roller holder 14 mounted on a guide box and that the tubular body of said twist guide member is fitted in said guide box with a body portion of said twist guide adjacent to the exit end thereof directly fitted in the cylindrical hollow of said roller holder so that the exit of said twist guide is held in closely spaced opposite relation to said pair of twist rollers; and eccentrically mounted positioning shafts 32, 38 for said twist rollers, and screw type connecting means 36, 37 operably connecting said shafts for symmetrical vertical displacement of said shafts 32 and, hence, of said twist rollers 34.

2. A twist roller guide device to be arranged between each two adjacent rolling mills in a set of aligned rolling mills and of the type including a pair of upper and lower twist rollers 34 and a twist guide member 1 having a guide bore 10 formed therein with two diametrically opposite helically extending wall surfaces 10*a* effective to preliminarily twist the stock as the latter proceeds through the guide bore, said device being characterized in that said pair of twist rollers are journaled on respective bearing plates 33 provided on a hollow cylindrical roller holder 14 mounted on a guide box and that the tubular body of said twist guide member is fitted in said guide box with a body portion of said twist guide adjacent to the exit end thereof directly fitted in the cylindrical hollow of said roller holder so that the exit of said twist guide is held in closely spaced opposite relation to said pair of twist rollers; and, said roller holder 14 having a flange forming a worm wheel segment 141 engaging a worm 16 positioned on said guide box, said worm being operative to rotate said roller holder about its longitudinal axis.

3. A twist roller guide device as in claim 2, and including eccentrically mounted positioning shafts 32, 38 for said twist rollers, and screw type connecting means 36, 37 operably connecting said shafts for symmetrical vertical displacement of said shafts 32 and, hence, of said twist rollers 34.

* * * * *